US008733971B2

(12) United States Patent
Venturini

(10) Patent No.: US 8,733,971 B2
(45) Date of Patent: May 27, 2014

(54) LED FLOODLIGHT FORMED WITH A STRATIFIED SHEET

(75) Inventor: Franco Venturini, Buccianasco (IT)

(73) Assignees: Lucilla Venturini, Buccinasco (IT); Tatiana Venturini, Buccinasco (IT); Vittoria Venturini, Buccinasco (IT)

( * ) Notice: Subject to any disclaimer, the term of this patent is extended or adjusted under 35 U.S.C. 154(b) by 32 days.

(21) Appl. No.: 13/387,150

(22) PCT Filed: Jul. 21, 2010

(86) PCT No.: PCT/IB2010/001810

§ 371 (c)(1), (2), (4) Date: Jan. 26, 2012

(87) PCT Pub. No.: WO2011/012963

PCT Pub. Date: Feb. 3, 2011

(65) Prior Publication Data

US 2012/0127717 A1 May 24, 2012

(30) Foreign Application Priority Data

Jul. 27, 2009 (IT) ..... CR2009A0029

(51) Int. Cl.
*F21V 5/00* (2006.01)
*F21V 19/00* (2006.01)

(52) U.S. Cl.
CPC ..... *F21V 19/001* (2013.01)
USPC ..... 362/244

(58) Field of Classification Search
CPC ..... F21V 19/001
USPC ..... 362/244
See application file for complete search history.

(56) References Cited

U.S. PATENT DOCUMENTS

| | | | | |
|---|---|---|---|---|
| 7,285,903 | B2 * | 10/2007 | Cull et al. | 313/500 |
| 2002/0001193 | A1 | 1/2002 | Osawa et al. | |
| 2003/0052594 | A1 | 3/2003 | Matsui et al. | |
| 2005/0263784 | A1 * | 12/2005 | Yaw et al. | 257/98 |

FOREIGN PATENT DOCUMENTS

| | | | |
|---|---|---|---|
| CN | 1496215 | A | 5/2004 |
| CN | 201100542 | Y | 8/2008 |
| DE | 201 14 085 | | 2/2002 |
| DE | 201 20 588 | | 4/2002 |

OTHER PUBLICATIONS

International Search Report dated Apr. 6, 2011, corresponding to PCT/IB2010/001810.

* cited by examiner

*Primary Examiner* — Anh Mai
*Assistant Examiner* — Hana Featherly
(74) *Attorney, Agent, or Firm* — Young & Thompson

(57) ABSTRACT

A LED floodlight (1), includes:
a plurality of LEDs (3) suitably arranged for use;
an electrical circuit (4) for powering the plurality of LEDs (3);
a finishing casing (5);
element of electrical connection (6) to a power supply network;
characterized in that it includes a stratified sheet (2), folded so as to suitably orient the beam from the floodlight (1), wherein the sheet (2) simultaneously serves as a mechanical support and as an electronic power and control board for the plurality of LEDs (3) and the electrical circuit (4) is obtained directly thereon.

17 Claims, 2 Drawing Sheets

LED FLOODLIGHT FORMED WITH A STRATIFIED SHEET

BACKGROUND OF THE INVENTION

The invention relates to the lighting technology sector: in particular, the invention concerns a LED floodlight that can be used above all for road lighting, or for lighting outdoor environments, or large indoor spaces.

LED floodlights used for this purpose are already known, comprising an opaque box-like containment element with a substantially spherical cup shape, a plurality of LED assemblies housed within said box-like element and linearly arranged on a plurality of circuit boards with a tape-like conformation, applied to metallic support strips joined at the top of said spherical cup, a closing optical screen for said box-like element made of transparent material, and an electrical power supply unit for said LEDs suitably connected by wires to the electrical control circuits of each tape-like board.

The LEDs used in said floodlights may indifferently emit white or coloured light, or be RGB type LEDs, and, in order to increase the luminous effect, they are often associated singly with a known type of lens, smooth or bossed, with a known property of concentrating or scattering the beams of light coming from a luminous source.

Also said closing optical screen has a smooth or machined surface with suitable bosses of different sizes, for further modulation of the light produced by all the LEDs.

This type of LED floodlight has certain limits and disadvantages.

The presence of a given structure constituted of tape-like boards on which the LEDs are positioned, applied to support strips, greatly conditions the distribution of the light sources, creating certain zones with a greater density of lighting power, and other zones with a lower specific lighting power. In fact, the strips inevitably cause a greater density of LEDs in the centre of the spherical cup and fewer LEDs towards the periphery. To ensure that the whole floodlight produces a uniform lighting effect, it is necessary to alternate, and carefully position on said support strips, LEDs with different lighting powers. Sometimes it may also be necessary to select only some LED assemblies to be supplied with, while others are kept switched off. This aim is achieved by means of a complex electrical control circuit, and a plurality of electrical cables.

Disadvantageously, the use of LEDs with different lighting power and the determination of their exact position, the use of several mechanical components for fastening said tape-like boards to the support strips and for joining the latter to the box-like element, and the use of electrical power supply and control cables and components for switching on each individual LED, greatly increase the time and costs involved in the construction of the floodlight, and maintenance costs when using the floodlight.

Furthermore, the presence of numerous electrical components increases the risk of short circuits and reduces the life-time of the appliance.

Lastly, the space inside the box-like element delimited by the closing optical screen, wherein the support strips for the LEDs are contained, disadvantageously retains a considerable concentration of heat, which is difficult to dissipate. To ensure lower temperatures inside said box-like element it is therefore necessary to use a smaller number of LEDs, or LEDs with lower light-emitting power, disadvantageously resulting however in a weaker light yield.

SUMMARY OF THE INVENTION

Aim of the invention is to eliminate these shortcomings, by improving the technical and functional performances compared to known LED floodlights, and by optimising the light yield with respect to energy consumption.

In particular, the object of the invention is to:

- increase the optical yield of the floodlight by homogenising the light beam emitted without having limits on the position of the LEDs in any particular direction;
- eliminate mechanical and electrical components, by reducing dimensions, costs and times of production and maintenance;
- ensure good thermal dissipation, with the possibility of using fewer but more powerful LEDs, thus cutting costs.

These aims are achieved with a LED floodlight comprising:

- a plurality of LEDs suitably arranged for use;
- an electrical circuit for powering said plurality of LEDs;
- a finishing casing;
- means of electrical connection to a power supply network, characterized in that it comprises a stratified sheet, folded so as to suitably orient the beam emission from the floodlight, wherein said sheet simultaneously serves as a mechanical support and as an electronic power and control board for said plurality of LEDs and said electrical circuit is obtained directly thereon.

According to preferred aspects of the invention, said sheet is continuous or has slender discontinuities with a radiating or parallel pattern.

In particular, said sheet comprises two overlapping continuous layers, one made of a heat-conducting material and one made of a dielectric material, such that the electrical circuit for powering said plurality of LEDs comprises tracks obtained directly on said dielectric material.

Advantageously, said heat-conducting material is an aluminium alloy, said dielectric material is Teflon or a similar material, and said electrical circuit is a copper alloy.

According to a further aspect of the invention, a layer of clear, bicomponent epoxy varnish is applied on top of said electrical circuit by means of a silkscreen printing process, to better reflect the light from the LEDs.

According to possible embodiments of the invention, said stratified sheet is folded along a curved surface with single or double curvature, and said plurality of LEDs is applied indifferently to the concave or convex side of said curved surface.

Advantageously, each LED is associated with an optical lens.

According to a preferred aspect of the invention, said finishing casing is in direct contact with said layer of heat-conducting material.

According to further aspects of the invention, said finishing casing is closed by means of a light-transparent wall, and said wall may be a lens, for example.

A further object of the invention is a procedure for the manufacture of a LED floodlight, characterized in that it comprises the following steps:

- preparation of an electrical circuit for powering a plurality of LEDs on a stratified flat sheet composed of a layer of ductile heat-conducting material covered with a layer of dielectric material;
- application of a layer of clear, bicomponent epoxy varnish by means of a silkscreen printing process on said electrical circuit, with the exception of the points where the LEDs are to be connected;
- attachment of the LEDs to said points;
- folding of said stratified sheet to obtain a sheet shaped and folded along suitable curvatures by means of a male and female mould, wherein the male portion contains holes for the passage of the LEDs;

application of a finishing casing in thermal contact with said heat-conducting layer of said shaped sheet, and of a transformer and of the corresponding means of connection to a power supply network.

Further aspects are disclosed in the dependent claims.

The advantages deriving from the construction features described above essentially consist in:

- the absolute freedom of positioning of the individual LEDs, with no more constraints associated with the arrangement of tape-like circuit boards acting as support strips;
- the possibility of folding the stratified LED support sheet into various curved forms, thereby obtaining any optical shape desired (concave, convex, parabolic, etc. . . . ), while leaving the LED electrical power circuit intact and orienting the beams of light in any preferred direction;
- the possibility of increasing the number of LEDs present at the periphery of the floodlight and reducing the number in the central area, to increase the width and depth of the beam of light emitted by the floodlight;
- the floodlight's maximum construction simplicity, without unnecessary, bulky mechanical components that increase the costs and times of production and maintenance;
- the reduction in the number of electrical components, resulting in greater safety, greater operating simplicity, and a further reduction in production and maintenance costs;
- the achievement of a good heat dissipation, thank to the direct contact between the heat-conducting layer of the stratified LED support sheet and the finishing casing, which has the same shape, and is also made of heat-conducting material.

In particular, by quickly dissipating the heat produced by the LEDs, it is possible, advantageously, to use LEDs with a greater illuminating power, without running the risk of overheating and damaging the floodlight components, and ensuring a longer lifetime for the entire device.

Even more advantageously, by using more powerful LEDs, it is possible to reduce their number, with a decrease in construction and labour costs.

BRIEF DESCRIPTION OF THE DRAWINGS

These and further advantages of the invention will become more evident from the following detailed description of preferred embodiments thereof, by way of non-limitative example, and with the help of drawings, wherein.

DETAILED DESCRIPTION OF THE PREFERRED EMBODIMENTS

Figure 1:
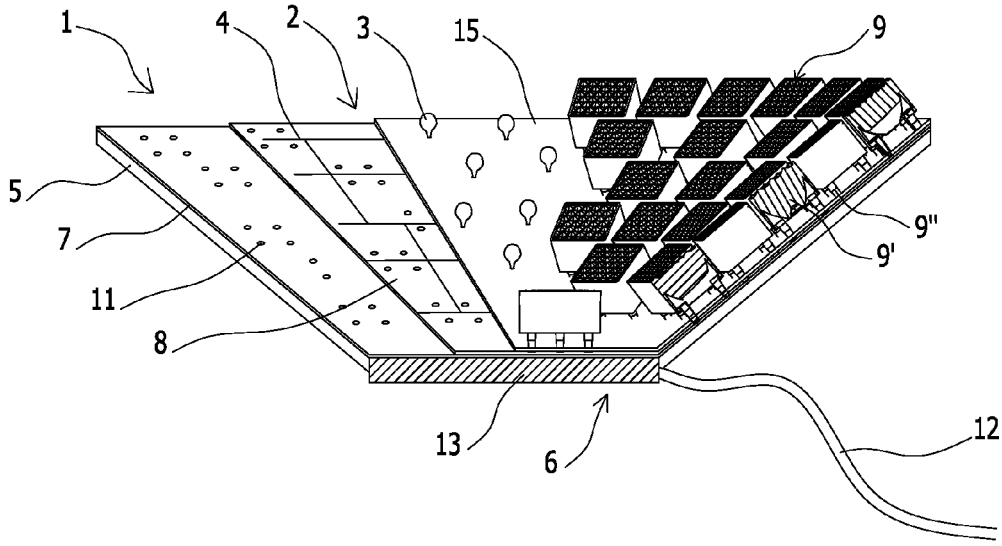
FIG. 1 shows a transverse cross-section of a LED floodlight according to the invention.
Figure 2:
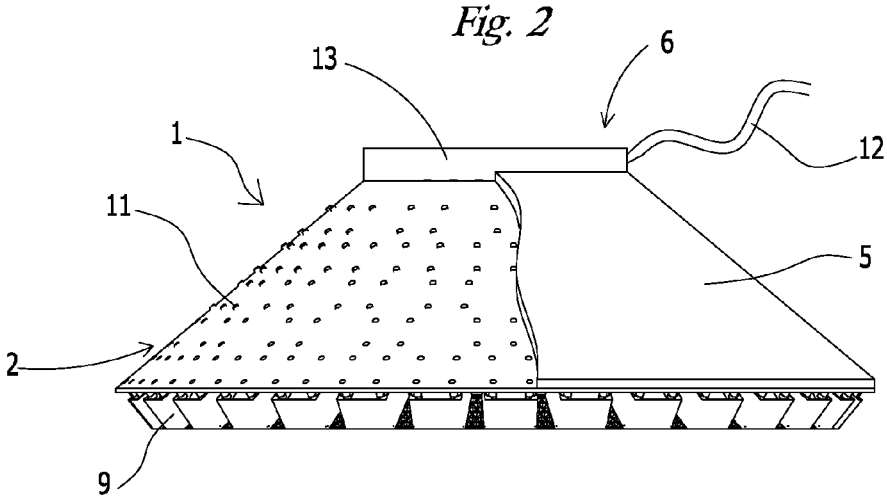
FIG. 2 shows a front, partial cross-section view of said LED floodlight.
Figure 3:
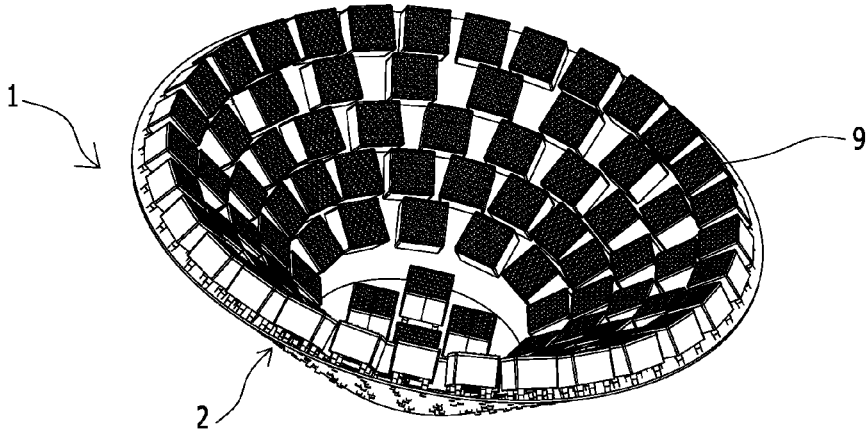
FIG. 3 shows a perspective view of the invention.
Figure 4:
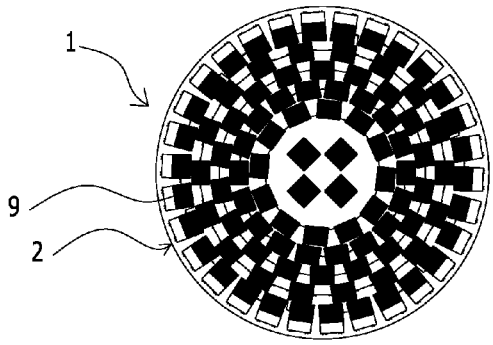
FIG. 4 shows an overhead plan view of the invention.

With reference to the Figures, the LED floodlight 1 according to the invention comprises a stratified sheet 2 arranged for supporting a plurality of LEDs 3 suitably arranged for use, an electrical circuit 4 for powering said plurality of LEDs 3, a finishing casing 5 and means of electrical connection 6 of said floodlight 1 to a power supply network.

Said stratified sheet 2 comprises two overlapping continuous layers, one made of a heat-conducting material 7 and one made of a dielectric material 8, such that the electrical-conducting circuit 4 is obtained directly on said stratified sheet 2, on top of said dielectric layer 8.

According to the embodiments illustrated, said heat-conducting material 7 is an aluminium alloy, said electrical circuit 4 is made of copper chemically etched to obtain the tracks of the circuit 4, and said dielectric material 8 is Teflon or another similar insulating material.

The surface finish of the stratified sheet 2 is achieved by applying a layer 15 of clear, two-component epoxy varnish on top of the circuit 4 by means of a silk-screen printing process.

With particular reference to FIGS. 1-4, said stratified sheet 2 is folded along a curved surface with single or double curvature, to form a sort of hollow dome, with a frustum of pyramid or paraboloid shape, inside which the LEDs 3 are arranged.

The LEDs 3 are directly associated with said stratified and folded sheet 2, and are arranged on it to create perfectly homogeneous beams of light, corresponding to the points of electrical connection arranged along the circuit 4, in areas without the finishing layer 15.

Each LED 3 is associated with an optical lens 9, constituted of a body 9' with a substantially truncated cone shape, provided with a specific niche arranged for housing said LED 3, and a plurality of supporting feet 9" arranged for being inserted into corresponding holes 11 provided on said stratified sheet 2.

In particular, said lenses 9 may be circular or polygonal in shape, with smooth or bossed surfaces, with more or less pronounced protuberances or projections.

Said finishing casing 5, which is also made of heat-conducting material, continuously surrounds said sheet 2, making the holes 11 made on said stratified and curved sheet 2, for arrangement of the optical lenses 9 corresponding to the individual LEDs 3, invisible from the outside.

Said means of electrical connection 6 substantially comprise a power supply cable 12 and a transformer 13 of a known type.

Figure 5:
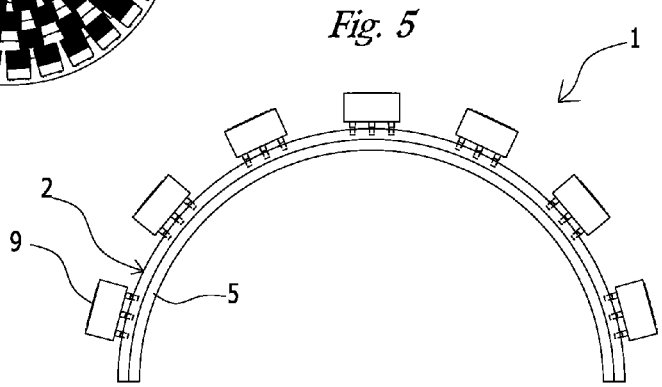
FIGS. 5 and 6 show a schematic transverse cross-section view of two possible variant embodiments.

With reference to FIG. 5, said stratified sheet 2 is folded along a surface with a single curvature and the floodlight 1 has the shape of a hollow semi-cylinder.

In particular, said plurality of LEDs 3 is applied to the convex side of said curved surface, while the finishing casing 5 is applied to the concave side of the same curved surface.

Figure 6:
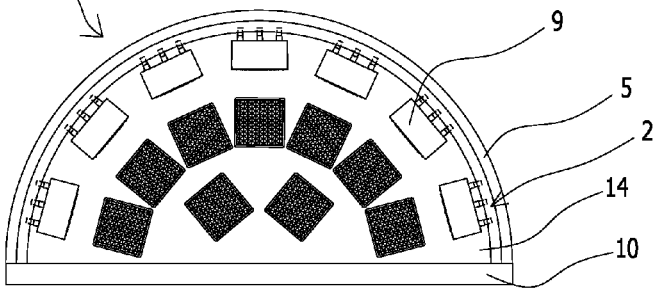

With reference to FIG. 6, said stratified sheet 2 is folded along a surface with a single curvature and the floodlight 1 is a closed "tunnel" type, i.e. in the shape of a hollow semi-cylinder and fitted with a closing wall 14, perpendicular to the longitudinal axis of said semi-cylinder.

Said plurality of LEDs 3 is applied to the concave side of said curved surface, and advantageously also to the closing wall 14, according to the specifications described above.

Figure 7:
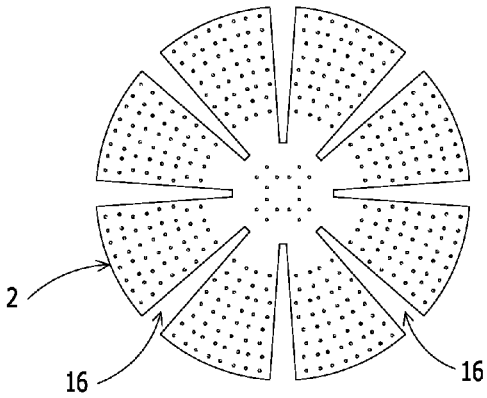
FIG. 7 shows an overhead plan view of a possible alternative construction of the stratified sheet for supporting the LEDs.

Lastly, with reference to the embodiment illustrated in FIG. 7, said stratified sheet 2 comprises slender discontinuities 16 with a radiating trend, particularly useful for folding the sheet 2 along a surface with a single or double curvature.

In general, for every geometric form assumed by the curved surface, the LEDs may be applied both to the concave face and to the convex face, depending on how the stratified sheet 2 is folded.

The finishing casing is advantageously closed by means of a light-transparent wall 10.

In particular, said wall 10 may be a lens and may have a smooth or bossed surface, with more or less pronounced protuberances or projections, in order to modulate the beams of light produced by the LEDs 3 and to create particular lighting effects.

The procedure for the manufacture of said floodlight 1 is described below.

A flat sheet composed of a layer of ductile heat-conducting material 7 is covered with a layer of dielectric material 8 thereby creating a stratified sheet 2 and subsequently, an electrical circuit 4 with copper tracks is created using a known technique of chemical etching. The circuit 4 is then covered with a layer of clear, two-component epoxy varnish 15 by means of a silkscreen printing process, with the exception of suitable connection points where the LEDs 3 are to be applied at a later stage.

Said stratified sheet 2 is then folded along suitable curvatures to obtain a shaped and folded sheet, by means of a male and female mould, wherein the male portion contains holes for the passage of the LED 3 during the folding phase, protecting said LEDs 3 from possible crushing or breakage.

Lastly, a finishing casing 5 is applied in thermal contact with the layer 7 of the stratified sheet 2, advantageously having the same curvature as the shaped sheet, together with a transformer 13 and the corresponding means of electrical connection 12 to a power supply network.

Naturally, without prejudice to the principle of the invention, the shapes, materials, dimensions and construction details may be varied with respect to the descriptions and illustrations given above, without straying from the scope of the present invention.

The invention claimed is:

1. A LED floodlight (1), comprising:

a plurality of LEDs (3) suitably arranged for use;

a printed electrical circuit (4) for powering said plurality of LEDs (3) arranged on a flexible board, said flexible board being folded for orienting a beam emission from the plurality of LEDs (3);

a housing casing (5); and means of electrical connection (6) to a power supply network, wherein said flexible board having said electrical circuit arranged thereon comprises a stratified sheet (2) with two overlapping continuous layers, a first layer made of a heat-conducting material (7) and a second layer made of a dielectric material (8), wherein said sheet (2) is configured to simultaneously serve as a mechanical support and as an electronic power and control board for said plurality of LEDs (3), and said electrical circuit (4) is obtained directly thereon.

2. The LED floodlight (1) according to claim 1, wherein said sheet (2) is continuous or has slender discontinuities (16) with a radiating or parallel pattern.

3. The LED floodlight (1) according to claim 1, wherein the electrical circuit (4) for powering said plurality of LEDs (3) comprises tracks obtained on said dielectric material (8).

4. The LED floodlight (1) according to claim 3, wherein said first layer of heat-conducting material (7) is an aluminum alloy, said dielectric material (8) is Teflon or a similar material, and said electrical circuit (4) is made of a copper alloy.

5. The LED floodlight (1) according to claim 3, wherein a layer (15) of clear, bicomponent epoxy varnish is applied on top of said electrical circuit (4) by means of silkscreen printing.

6. The LED floodlight (1) according to claim 3, wherein said finishing casing (5) is in direct contact with said first layer of heat-conducting material (7).

7. The LED floodlight (1) according to claim 6, wherein said housing casing (5) is closed by means of a light-transparent wall (10).

8. The LED floodlight (1) according to claim 7, wherein said transparent wall (10) is a lens.

9. The LED floodlight (1) according to claim 1, wherein said stratified sheet (2) is folded along a curved surface with single or double curvature.

10. The LED floodlight (1) according to claim 9, wherein said plurality of LEDs (3) is applied to the concave or convex side of said curved surface.

11. The LED floodlight (1) according to claim 1, wherein each LED (3) is associated with an optical lens (9).

12. A LED floodlight, comprising:

a plurality of LEDs;

a flexible stratified sheet with a printed electrical circuit provided thereon for powering said plurality of LEDs, the plurality of LEDs in electrical connection with the electrical circuit, and said flexible stratified sheet having a curved surface for orienting a beam emission from the plurality of LEDs, said stratified sheet having two overlapping continuous layers, a first layer made of a heat-conducting material and a second layer made of a dielectric material;

a housing casing in thermal contact with said first layer; and means to connect the electrical circuit to a power supply network, wherein said sheet mechanical supports said LEDs and said electrical circuit for said plurality of LEDs, and wherein said electrical circuit is provided directly on the surface of the sheet.

13. The LED floodlight according to claim 12, wherein the electrical circuit for powering said plurality of LEDs comprises tracks obtained on said dielectric material.

14. The LED floodlight according to claim 13, wherein a layer of clear, bicomponent epoxy varnish is applied on top of said electrical circuit.

15. The LED floodlight according to claim 13, wherein said finishing casing is in direct contact with said first layer of heat-conducting material.

16. The LED floodlight according to claim 12, wherein said housing casing is closed by means of a light-transparent wall.

17. The LED floodlight according to claim 16, wherein said transparent wall is a lens.

* * * * *